US005808414A

United States Patent [19]

Wharmby et al.

[11] Patent Number: 5,808,414

[45] Date of Patent: Sep. 15, 1998

[54] ELECTRODELESS FLUORESCENT LAMP WITH AN ELECTRICALLY CONDUCTIVE COATING

[75] Inventors: David Osborn Wharmby; Mohamed Hanif Girach, both of Leicestershire, England

[73] Assignee: General Electric Company, Schenectady, N.Y.

[21] Appl. No.: 407,531

[22] Filed: Mar. 20, 1995

[30] Foreign Application Priority Data

Mar. 18, 1994 [GB] United Kingdom ..... 9405371

[51] Int. Cl.[6] ..... H05B 41/00; H01J 65/00

[52] U.S. Cl. ..... 313/607; 313/635; 313/161; 313/594; 313/234; 315/248; 315/344

[58] Field of Search ..... 313/635, 607, 313/160, 161, 594, 234; 315/248, 344, 338, 347, 348, 70

[56] References Cited

U.S. PATENT DOCUMENTS

| | | | |
|---|---|---|---|
| 4,492,898 | 1/1985 | Lapatovich et al. | 313/607 X |
| 4,727,294 | 2/1988 | Houkes et al. | 315/248 |
| 4,977,354 | 12/1990 | Bergervoet et al. | 313/161 X |
| 5,239,238 | 8/1993 | Bergervoet et al. | 315/248 |
| 5,412,280 | 5/1995 | Scott et al. | 313/607 X |
| 5,461,284 | 10/1995 | Roberts et al. | 315/248 X |

*Primary Examiner*—Ashok Patel
*Attorney, Agent, or Firm*—George E. Hawranko

[57] ABSTRACT

An electrodeless fluorescent lamp having a lamp envelope with an inner phosphor coating and containing a fill capable of sustaining a discharge when suitably excited by an electric field includes an electrically conductive coating on the exterior of the lamp envelope. The electrically conductive coating is also light transmissive and is effective for confining the electric field to within the lamp envelope.

10 Claims, 2 Drawing Sheets

ELECTRODELESS FLUORESCENT LAMP WITH AN ELECTRICALLY CONDUCTIVE COATING

FIELD OF THE INVENTION

The present invention relates to an electrodeless fluorescent lamp. More particularly, this invention relates to such a lamp as includes an electrically conductive coating on the lamp envelope which serves to reduce interference.

BACKGROUND OF THE INVENTION

Such a lamp is disclosed in U.S. Pat. No. 4,727,294 (U.S. Philips Corporation). The lamp of U.S. Pat. No. 4,727,294 comprises an externally spherical lamp envelope which is sealed and which contains a fill capable of sustaining a discharge when suitably excited. The discharge excites a phosphor coating on the inside of the envelope. The fill is excited by a winding which is energized by a high frequency, e.g., RF, oscillator. The winding surrounds a core of magnetic material in U.S. Pat. No. 4,727,294. The core and winding project into a cylindrical sealing member of the envelope which projects, in re-entrant fashion, into the spherical envelope. The lamp envelope is further provided with a light transparent, electrically conductive layer within the envelope to substantially confine the electric field generated by the core and winding within the envelope. In order to reduce conducted interference in U.S. Pat. No. 4,727,294, a portion of the external surface of the envelope is also provided with a conductive coating capacitively coupled to the conductive layer inside the envelope. The external coating is connected by a conductor to a lamp cap, i.e., a power mains terminal, of the lamp.

In U.S. Pat. No. 4,727,294 an electrically insulative, generally cylindrical, housing supports the spherical lamp envelope and the re-entrant sealing member. The housing has a diameter smaller than the spherical lamp envelope. The housing contains the oscillator circuit and mechanically connects the lamp envelope to the lamp cap. The portion of the external surface of the envelope which is provided with the conductive coating is inside the housing for electrical safety limiting the area available for the capacitive coupling and thus limiting the impedance of the coupling to an undesirably high value.

Providing the conductive coating on the inner surface of the lamp envelope produces two problems. Firstly, the actual coating process is difficult and secondly, it is difficult to arrange a satisfactory electrical coupling between the RF ground and the inner conductive layer.

According to the present invention, there is provided an electrodeless fluorescent lamp comprising a sealed lamp envelope containing a luminescent layer and a fill capable of sustaining a discharge when suitably excited by an electric field; and a coating, on the external surface of the envelope, of electrically conductive light transparent material for confining the electric field within the envelope.

Providing the conductive coating on the outer surface of the envelope reduces the difficulty of the coating process and avoids the problem of electrical coupling to an inner conductive layer.

In an embodiment of the invention, means are provided for electrically coupling the outer coating to an electrical ground point within the lamp to reduce conducted interference.

In an embodiment of the invention, in which there is provided a mains powered means for producing the electric field, there is provided a mains decoupling capacitor electrically connected to the said external electrically conductive coating.

The outer conductive coating, when provided, is easily damaged and because it is, in use, coupled to the exciter means of the lamp which may be mains powered, it may be a potential source of electrical shock. Thus, according to a preferred embodiment of the invention, the lamp further comprises a light transmissive coating of electrically insulative material over the said external electrically conductive coating.

BRIEF DESCRIPTION OF THE INVENTION

For a better understanding of the invention, reference will now be made, by way of example, to the accompanying drawings in which.

DETAILED DESCRIPTION OF THE INVENTION

Figure 1:
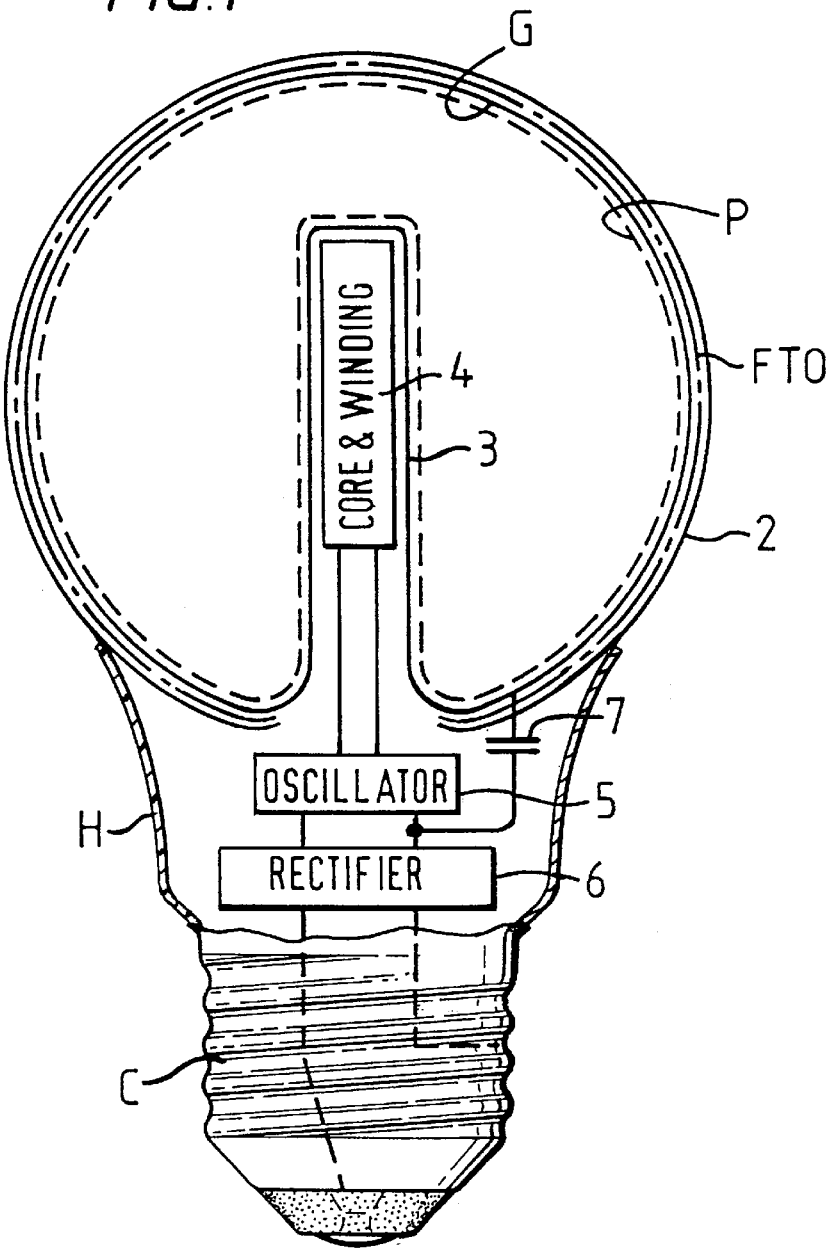
FIG. 1 is a schematic sectional side view of an illustrative electrodeless fluorescent lamp in accordance with the invention.

Referring to FIG. 1, the illustrative electrodeless lamp comprises a sealed glass envelope G shown as generally spherical but which may be of any suitable shape. A re-entrant cylinder 3 also of glass is fused to the envelope G. The envelope contains a fill (not shown) e.g., of mercury and a rare gas, which, when excited, produces a discharge of ultraviolet (UV) light. On the internal surface of the envelope is a layer of phosphor P which converts the UV light into visible light as in a conventional fluorescent lamp. The phosphor P covers not only the internal surface of the envelope G but also the surface of the cylinder 3.

A further coating (not shown) may be provided between the phosphor layer and the glass to reduce blackening of the envelope with age, as is known in the art.

The fill is excited by an electromagnetic field produced by a winding, comprising turns of copper wire. The turns are preferably arranged around a magnetic core of e.g., ferrite. The winding and core 4 are arranged in the re-entrant cylinder 3.

Figure 2:
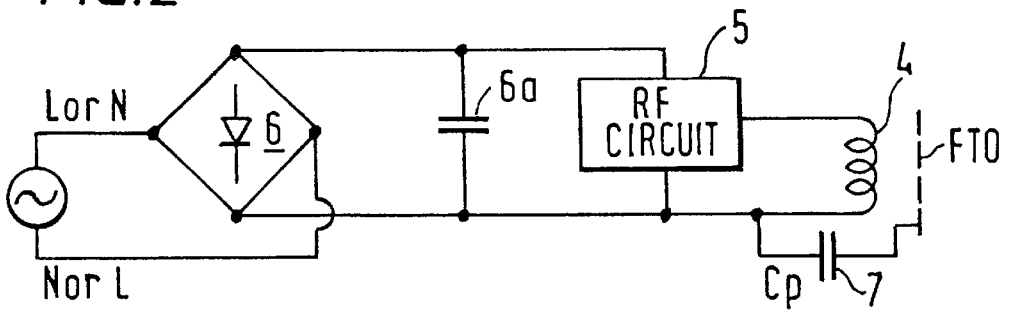
FIG. 2 is a schematic circuit diagram of the lamp of FIG. 1.

The winding is excited at high frequency e.g., 2.65 MHz by RF excitation means comprising for example an oscillator 5 powered from the power mains via a rectifier 6 and smoothing capacitor 6*a* (shown in FIG. 2).

The RF excitation means is housed in an electrically insulative housing H to which a lamp cap C is fixed.

In order to substantially confine the high frequency field to the lamp envelope, a light transparent, electrically conductive coating FTO is provided over the entire external surface of the lamp envelope but not over the surface of the cylinder 3. The coating has sufficient resistance e.g., at least 10 ohms per square so that it does not present a short-circuit to the winding 4. 300 ohms per square may be used. The coating FTO is preferably of fluorine-doped tin oxide but may be of other materials known to be suitable in the art.

In order to reduce or eliminate conducted interference the coating FTO is coupled to RF ground, via a decoupling capacitor 7 having capacitance Cp which provides high impedance to mains frequency but low impedance to the RF.

The value of Cp is such that the reactance at the RF frequency is much less than the resistance of the coating (so that it provides insignificant impedance to the flow of current when compared with the coating itself). It must also be high impedance at 50 Hz because mains contact currents are limited to less than 500 $\mu$A (National Radiological Protection Board (NRPB)—Board Statement on Restrictions on Human Exposure to standard time varying electromagnetic fields and radiation) Documents of NRPB, Vol. 4 No. 5 1993.

In addition capacitor 7 must be Class Y (supply voltage less than 250V) or Class U (supply voltage less than 125V). Such capacitors are defined in IEC 384-14 (1981) as being "of a type suitable for use in situations where failure of the capacitor could lead to danger of electric shock".

There are many ways of making connection between the capacitor and the external coating FTO. Examples are:

A metal strip attached to coating FTO with conducting cement to which capacitor is welded, soldered or crimped.

Figure 3:
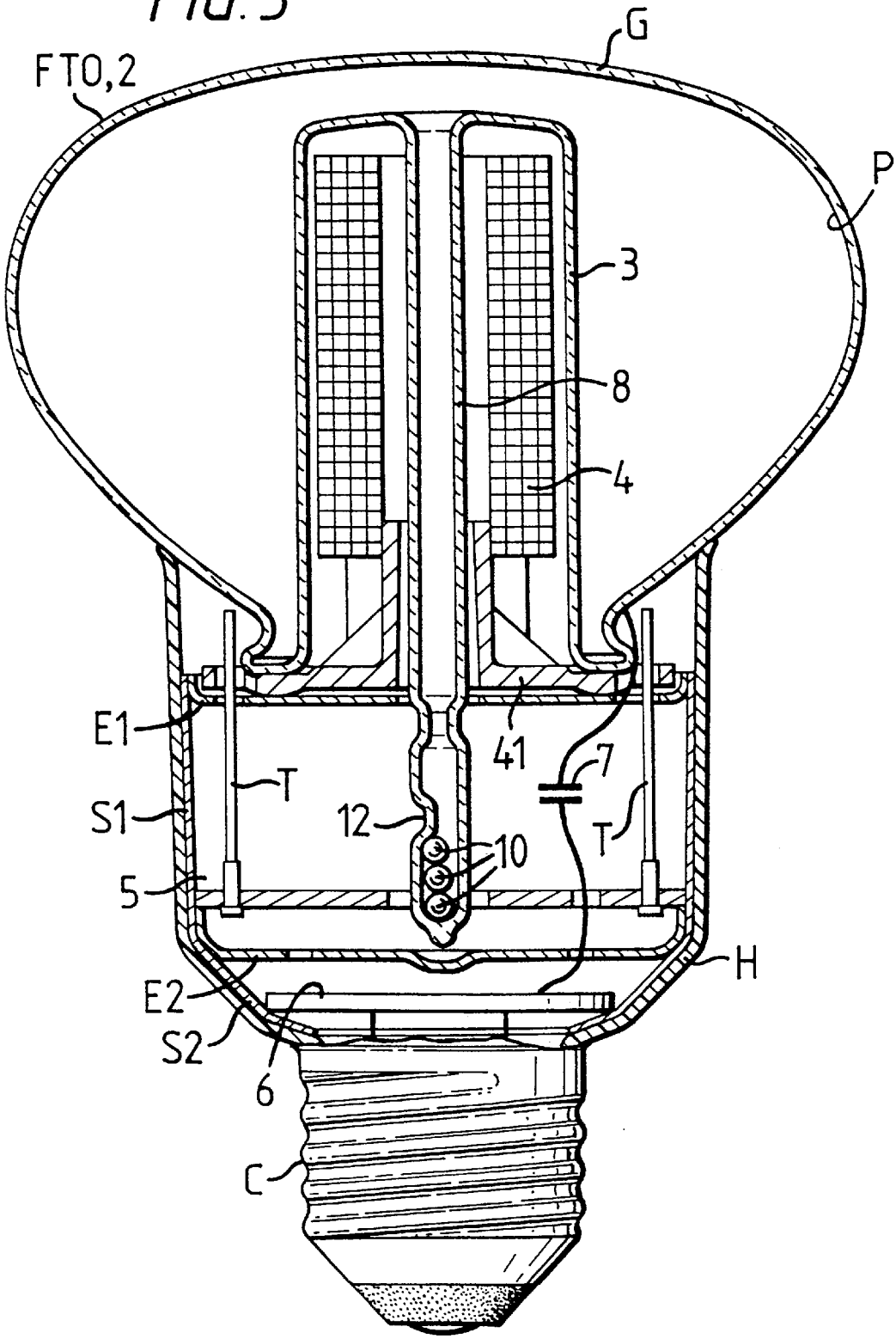
FIG. 3 is a schematic side view of another electrodeless fluorescent lamp in accordance with the invention.

Spring fingers that slip over the seal area lip (in FIG. 3). The spring finger is used to retain the lamp envelope in the housing.

A conducting coating on the housing. Contact is made by snap fitting the lamp envelope into housing. The capacitor 7 is bonded or crimped to a lug on the housing.

Providing the coating FTO on the external surface of the envelope G makes the connection of the decoupling capacitor 7 to the coating simpler. Also, the decoupling capacitor 7 can then be chosen for its electrical requirements without other constraints.

Providing the coating FTO on the external surface of the envelope also reduces the difficulty of the coating process. The coating however is easily damaged. Furthermore, as shown in FIG. 2, the coating FTO is connected to RF zero via the capacitor 7 which—because of the use of a rectifier bridge has mains voltage 50 Hz embedded on it.

To provide the user with additional isolation from mains the external FTO coat is coated with a transparent insulative coating. The coating may be chosen from: inorganic material; plastics; silicone; and latex; an example being "Modified Silicone Conformal coating". The material may be sprayed, painted, dipped or otherwise deposited on the lamp envelope.

FIG. 3 is a schematic view of another embodiment of a lamp in accordance with the invention. The lamp of FIG. 3 comprises a glass envelope G, a re-entrant cylinder 3, a winding and core 4, an oscillator 5, a rectifier 6, a capacitor 7, a housing H and a cap C generally as described with respect to FIG. 1. The envelope G contains a fill, and has on its internal surface at least a layer of phosphor P as described with reference to FIG. 1. The envelope G has on its external surface a light transparent coating FTO of electrically conductive material covered by a light transparent coating 2 of electrically insulative material also generally described with reference to FIG. 1.

The mains decoupling capacitor 7 is electrically connected by conductive wire 9 between the coating FTO and an RF zero point on the rectifier board within the housing H.

Within the housing is a substantially closed metal box having a generally cylindrical side wall portion S1 between upper and lower end walls E1 and E2, and an extension S2 of the side wall which extends towards the lamp cap. The closed box S1,E1,E2 contains the oscillator 5, provides electrical shielding for the oscillator, and also acts as a heat sink. The extension S2 supports the rectifier 6. Terminals T extending through end wall El connect the oscillator 6 to the winding and core 4, the circuit board 41 of which is supported by the end wall E1.

The lamp envelope G is supported by and glued to, the circuit board 41 of the core and winding, although other support arrangements may be used.

The core and winding 4 forms a hollow cylinder through which extends a tube 8 which re-entrantly extends through the cylinder 3. The tube 8 extends through the box S1,E1,E2. The tube 8 contains mercury amalgam 10 retained by a dimple 12 within the end portion of the tube inside the box.

The lamps described hereinbefore may be modified in various ways. For example, the ballast, i.e., the core and winding 4, oscillator 5 and rectifier 6, may be made and sold separately from the lamp envelope in which case suitable means for connecting the lamp envelope to the ballast must be provided. Such means are within the skill of those skilled in the art.

The decoupling capacitor may, in theory, be omitted in which case the coating FTO is connected directly to RF zero and the insulative coating 2 must be provided for electrical safety. However, in the circuit of FIG. 2, RF zero is coupled to the mains supply via the rectifier 6 and RF zero thus has mains voltage embedded on it. In this situation safety requires that the insulative coating 2 must be designed to outlast the lamp, remaining insulative under all conditions of use.

It is possible to use an isolating transformer between mains and the rectifier providing an RF zero point isolated from mains.

When the decoupling capacitor or other mains isolation is provided it is, in theory, possible to omit the transparent insulative coating. Tests have shown that the contact current is within permissible levels.

The light transparent electrically insulative coating may be replaced by a light translucent, or otherwise light transmissive, electrically insulative coating.

The FTO coating in the embodiments described above is thick enough to alone provide a lower resistance for RF to ground. The FTO could be made thinner and covered in a fine mesh of conductive material, e.g., metal wire, to provide the low resistance without obstructing the light output.

The lamps described hereinbefore may be modified to act as reflector lamps by the addition of a reflective layer (not shown) under the phosphor layer P in the portion of the lamp envelope adjacent the housing H. The reflective layer may be of titania for example.

We claim:

1. An electrodeless fluorescent lamp comprising a sealed lamp envelope containing a luminescent layer and a fill capable of sustaining a discharge when suitably excited by an electric field, and a coating, on the external surface of the envelope, of electrically conductive light transmissive material for confining the electric field within the envelope and a light transmissive coating of electrically insulating material over said electrically conductive coating.

2. A lamp according to claim 1, further comprising means for producing the said electric field.

3. A lamp according to claim 2 wherein the field producing means is mains powered and further comprising a mains decoupling capacitor electrically connected to the said external electrically conductive coating.

4. A lamp according to claim 1 wherein said coating is comprised of fluorine doped tin oxide.

5. An electrodeless fluorescent lamp comprising:

a sealed lamp envelope containing a luminescent layer and a fill capable of sustaining a discharge when suitably excited by an RF electric field;

means for producing the electric field;

a coating on the external surface of the envelope, of electrically conductive light transmissive material for confining the electric field within the envelope;

a light transmissive coating of electrically insulating material over said coating of electrical conductive material; and means for coupling the coating to an RF ground of the field producing means.

6. A lamp according to claim 5 wherein the field producing means is mains powered, and comprising safety means for preventing any contact surface of the lamp from being at mains potential.

7. A lamp according to claim 6 wherein a mains decoupling capacitor is electrically interconnected between the coating of electrically conductive material and said RF ground and provides both the means for coupling the coating to an RF ground and the safety means.

8. A lamp according to claim 6 wherein the means for coupling the coating to an RF ground comprises a decoupling capacitor.

9. A lamp according to claim 5 wherein the said means for coupling the coating to an RF ground comprises a conductive connection of the coating to the said RF ground.

10. A lamp of claim 5 wherein said coating is comprised of fluorine doped tin oxide.

* * * * *